US007455009B2

(12) United States Patent
Theodore, Jr. et al.

(10) Patent No.: US 7,455,009 B2
(45) Date of Patent: Nov. 25, 2008

(54) HINGE FOR A VARIABLE DISPLACEMENT COMPRESSOR

(75) Inventors: Michael G. Theodore, Jr., Plymouth, MI (US); Rodney J. Callahan, Novi, MI (US); Pete E. Ganster, Plymouth, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 119 days.

(21) Appl. No.: 11/450,823

(22) Filed: Jun. 9, 2006

(65) Prior Publication Data

US 2007/0283804 A1 Dec. 13, 2007

(51) Int. Cl.
*F04B 27/08* (2006.01)
*F04B 39/00* (2006.01)

(52) U.S. Cl. ..... 92/12.2; 92/71

(58) Field of Classification Search ..... 92/12.2, 92/71

See application file for complete search history.

(56) References Cited

U.S. PATENT DOCUMENTS 4,178,135 A 12/1979 Roberts
4,294,139 A 10/1981 Bex et al.
4,553,905 A 11/1985 Swain et al.
4,815,358 A * 3/1989 Smith ..... 92/12.2
4,860,789 A 8/1989 Scaramucci
5,259,736 A 11/1993 Terauchi
5,282,725 A 2/1994 Shimizu
5,425,303 A 6/1995 Shimizu et al.
5,567,124 A 10/1996 Takenaka et al.
5,706,716 A 1/1998 Umemura
5,749,712 A 5/1998 Umemura
5,785,503 A 7/1998 Ota et al.
5,850,775 A * 12/1998 Stiefel ..... 92/12.2
6,044,751 A 4/2000 Kimura et al.
6,056,514 A 5/2000 Fukai
6,139,282 A 10/2000 Ota et al.
6,139,283 A 10/2000 Ahn
6,158,968 A * 12/2000 Nakamura ..... 417/222.1
6,179,571 B1 1/2001 Kawachi et al.
6,186,048 B1 2/2001 Kimura et al.
6,470,761 B1 10/2002 Nakamura et al.

(Continued)

FOREIGN PATENT DOCUMENTS

JP 01110879 A 4/1989

(Continued)

*Primary Examiner*—Thomas E Lazo
(74) *Attorney, Agent, or Firm*—Brinks Hofer Gilson & Lione

(57) ABSTRACT

A variable displacement compressor is provided. The compressor has a crankcase, a plurality of pistons, a swash plate, and a rotor assembly. The crankcase has a plurality of chambers for receiving a fluid. The plurality of pistons are disposed within the cylinder block and are configured for reciprocal movement within the plurality of chambers to pump the fluid. The swash plate is slidably coupled to the plurality of pistons and has a first hinge member extending from a surface of the swash plate. The first hinge member has a surface that has a cam profile. The rotor assembly has a rotor shaft and a rotor plate. The rotor plate has a second hinge member extending from a surface of the rotor plate, whereby the surface of the first member is configured to slide and rotate over the second hinge member forming a hinge about which the swash plate rotates.

17 Claims, 8 Drawing Sheets

U.S. PATENT DOCUMENTS

| | | | | |
|---|---|---|---|---|
| 6,474,183 | B1 | 11/2002 | Uchikado | |
| 6,572,342 | B2 | 6/2003 | Ahn et al. | |
| 6,604,447 | B2 | 8/2003 | Iizuka et al. | |
| 6,629,823 | B2 | 10/2003 | Ota et al. | |
| 6,742,439 | B2 * | 6/2004 | Matsuda et al. | 92/12.2 |
| 6,786,705 | B2 | 9/2004 | Kurita et al. | |
| 6,860,188 | B2 * | 3/2005 | Pitla et al. | 92/12.2 |
| 2002/0085927 | A1 | 7/2002 | Ota et al. | |
| 2003/0007877 | A1 | 1/2003 | Kurita et al. | |
| 2003/0095874 | A1 | 5/2003 | Tagami | |
| 2003/0108433 | A1 | 6/2003 | Ahn | |
| 2003/0223887 | A1 | 12/2003 | Kawano et al. | |
| 2004/0055456 | A1 | 3/2004 | Kurita et al. | |
| 2004/0149058 | A1 | 8/2004 | Ebbing et al. | |
| 2005/0147503 | A1 | 7/2005 | Kurita et al. | |
| 2005/0180860 | A1 | 8/2005 | Dewispelaere et al. | |
| 2005/0186086 | A1 | 8/2005 | Ota et al. | |

FOREIGN PATENT DOCUMENTS

| | | | |
|---|---|---|---|
| JP | 03160162 | A | 7/1991 |
| JP | 03210079 | A | 9/1991 |
| JP | 2002180952 | A | 6/2000 |
| JP | 2000265947 | A | 9/2000 |

* cited by examiner

HINGE FOR A VARIABLE DISPLACEMENT COMPRESSOR

TECHNICAL FIELD

The present invention relates to air conditioning compressors for pumping refrigerant through a refrigerant circuit and to variable displacement compressors having a swash plate for adjusting the refrigerant pumping capacity of the compressor.

BACKGROUND OF THE INVENTION

A variable displacement compressor adjusts its refrigerant pumping displacement to match cooling load of the air conditioning system. Typically, a control valve is employed to regulate the pressure inside the crankcase of the compressor to match the displacement of the refrigerant to the cooling load. The variable displacement compressor includes a swash plate that is pivotally mounted to a drive shaft by a hinge. The swash plate converts the rotary movement of the drive shaft to reciprocating movement of the pistons inside the cylinder block of the compressor.

While conventional variable displacement compressors achieve their intended purpose, problems still exit. For example, conventional hinges typically have numerous parts that add mass to the assembly and is a source of vibration.

Therefore, a need exists for a swash plate hinge for a variable displacement compressor that has a low mass, few parts and a constant clearance volume regardless of the swash plate angle.

BRIEF SUMMARY

A variable displacement compressor is provided. The compressor has a crankcase, a cylinder block, a plurality of pistons, a swash plate, and a rotor assembly. The cylinder block has a plurality of chambers for receiving a fluid. The plurality of pistons are disposed within the cylinder block and are configured for reciprocal movement within the plurality of chambers to pump the fluid. The swash plate is slidably coupled to the plurality of pistons and has a first hinge member extending from a surface of the swash plate. The first hinge member has a surface that has a cam profile. The rotor assembly has a drive shaft and a rotor plate. The rotor plate has a second hinge member extending from a surface of the rotor plate, whereby the surface of the first member is configured to slide and rotate over the second hinge member forming a hinge about which the swash plate rotates.

In another embodiment of the present invention, the surface of the first hinge member includes a pair of curved surfaces.

In yet another embodiment of the present invention, a trajectory of the swash plate having the cam profile of the surface of the first hinge member is described by the following equations:

$$X = A\cos\theta + \frac{B\cos^2\theta}{\sin\theta} - C\cos\theta - \frac{B}{\sin\theta} + \frac{C}{\cos\theta} \text{ and}$$

$$Y = A\sin\theta + B\cos\theta - C\sin\theta.$$

In yet another embodiment of the present invention, the second hinge member includes a pin press fitted into a bore in the second hinge member.

In yet another embodiment of the present invention, the second hinge member includes a pin slip fitted into a bore in the second hinge member.

In yet another embodiment of the present invention, a second hinge member surface for supporting the pin is included.

In yet another embodiment of the present invention, the hinge is formed by the contact of the surface having the cam profile with the pin.

In yet another embodiment of the present invention, the surface having the cam profile is offset from the pin having a diameter D by a distance D/2.

In yet another embodiment of the present invention, a spring is disposed around the drive shaft for biasing the swash plate away from the rotor plate.

In still another embodiment of the present invention, the second hinge member includes a pair of pins.

In still another embodiment of the present invention, a second hinge member surface is provided for supporting the pair of pins.

In still another embodiment of the present invention, the pair of pins is press fitted into the second hinge member.

In still another embodiment of the present invention, the pair of pins is slip fitted into the second hinge member.

F*ig*. 8 includes three triangles, which illustrate mathematical relationships used to determine the cam equations, Equations 1and 2.

DETAILED DESCRIPTION OF THE INVENTION

Figure 1:
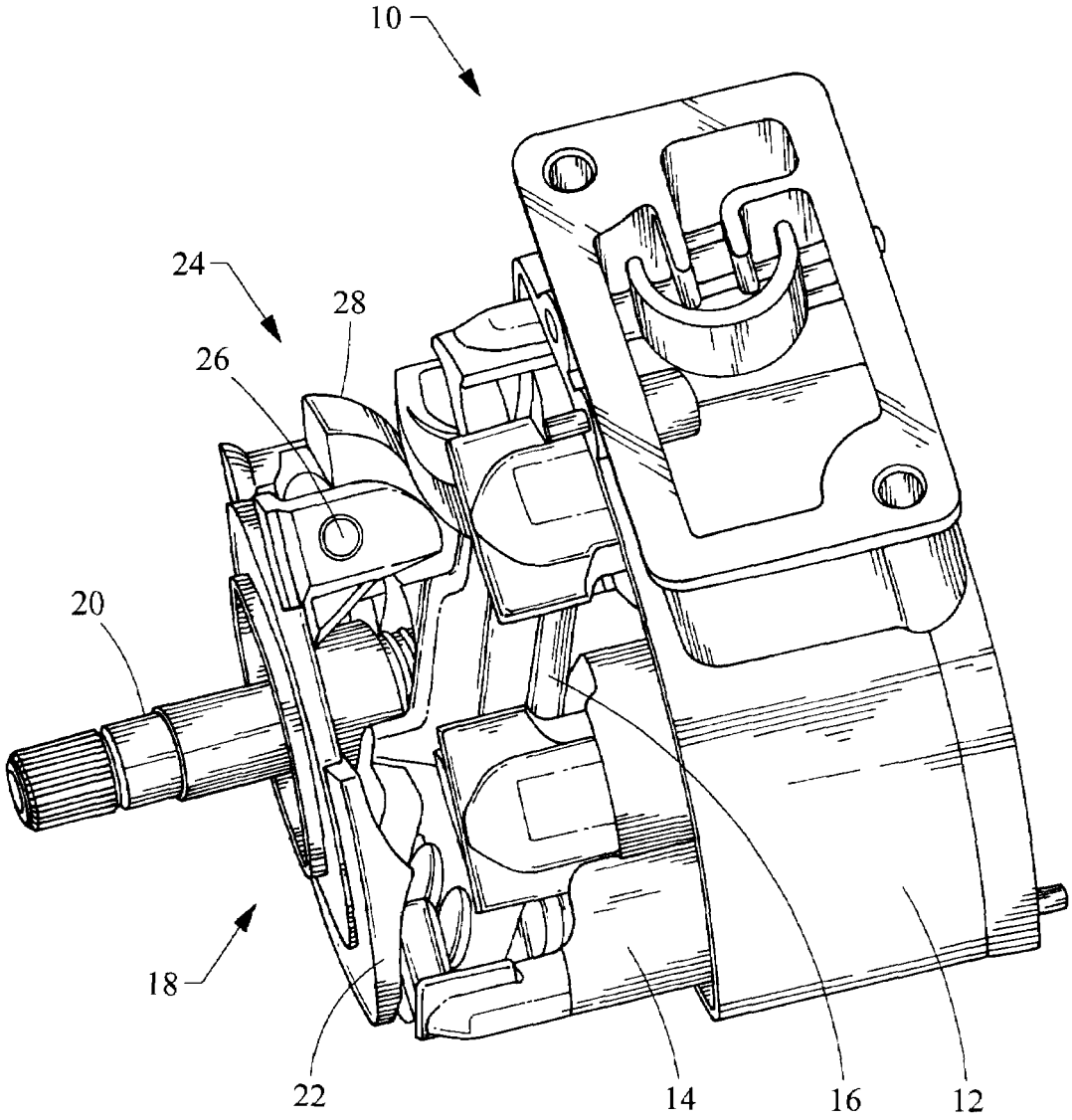
FIG. 1 is a perspective view of a partially assembled variable displacement compressor illustrated in accordance with an embodiment of the present invention.

Referring now to FIG. 1, a variable displacement compressor 10 is illustrated in accordance with an embodiment of the present invention. Compressor 10 includes a cylinder block 12 that reciprocatively receives a plurality of pistons 14. Pistons 14 are coupled to a swash plate 16 in a conventional manner, for example, as disclosed in U.S. Pat. No. 2,964,234, herein incorporated by reference. Swash plate 16 cooperates with a rotor assembly 18 to convert rotary movement of the rotor assembly 18 into reciprocating movement of pistons 14. Rotor assembly 18 includes a drive shaft 20 affixed to a rotor 22. As will be discussed in greater detail below, a hinge 24 is created through the pivotal contact of a first hinge portion 26 formed in rotor 22 and a second hinge portion 28 formed in swash plate 16.

Figure 2:
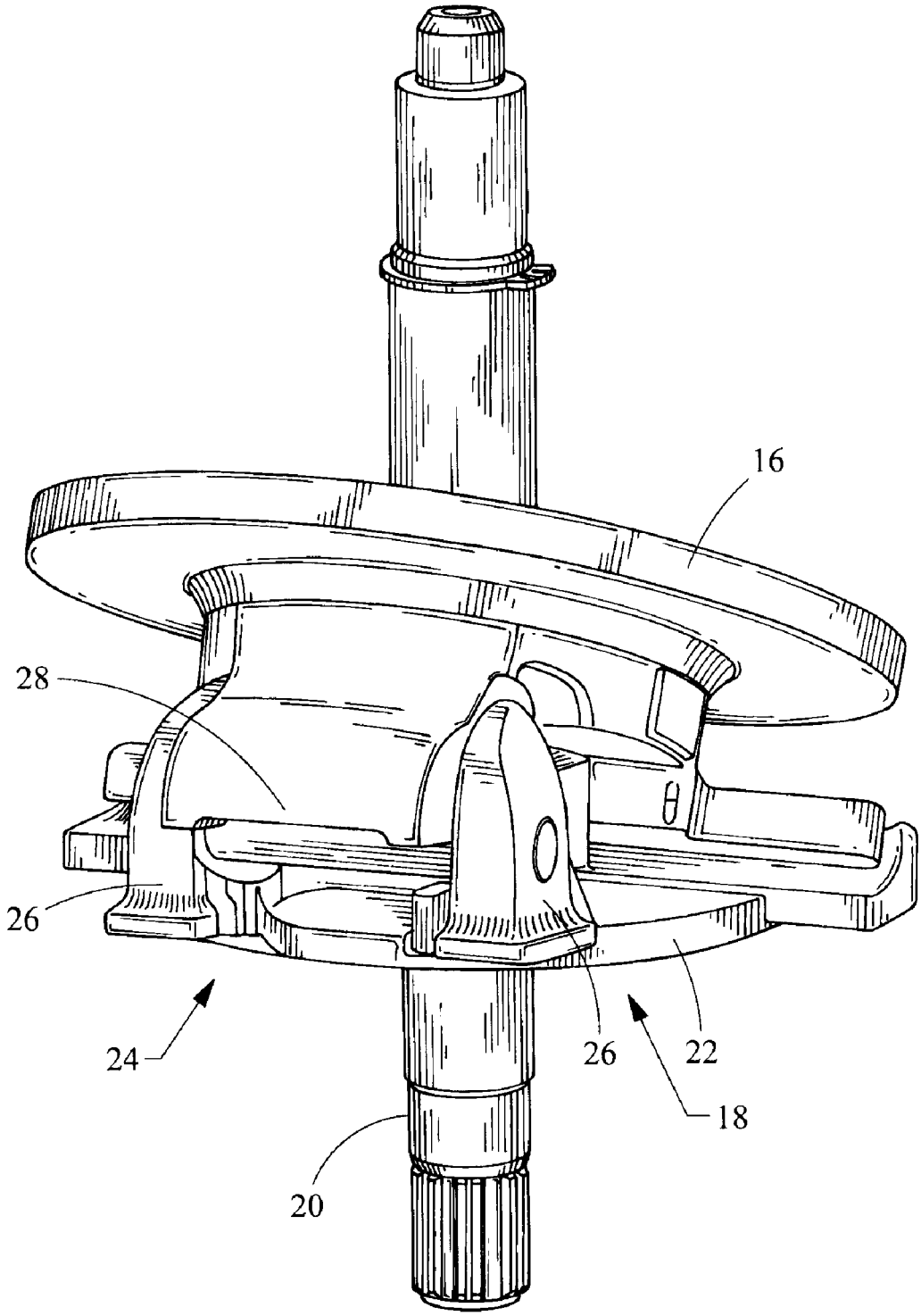
FIG. 2 is a perspective view of a swash plate coupled to a rotor assembly illustrated in accordance with an embodiment of the present invention.

Referring now to FIG. 2, swash plate 16 and rotor assembly 18 are shown in greater detail, in accordance with an embodiment of the present invention. As shown, swash plate 16 includes a second hinge portion or hub 28 that is configured to cooperate with first hinge portion 26 of rotor 22 to form hinge 24. Hinge 24 allows swash plate 16 to pivot, thereby changing the angle of the swash plate. The change in swash plate angle increases or decreases the stroke of the pistons thereby changing the overall refrigerant displacement of the compressor.

Figure 3:
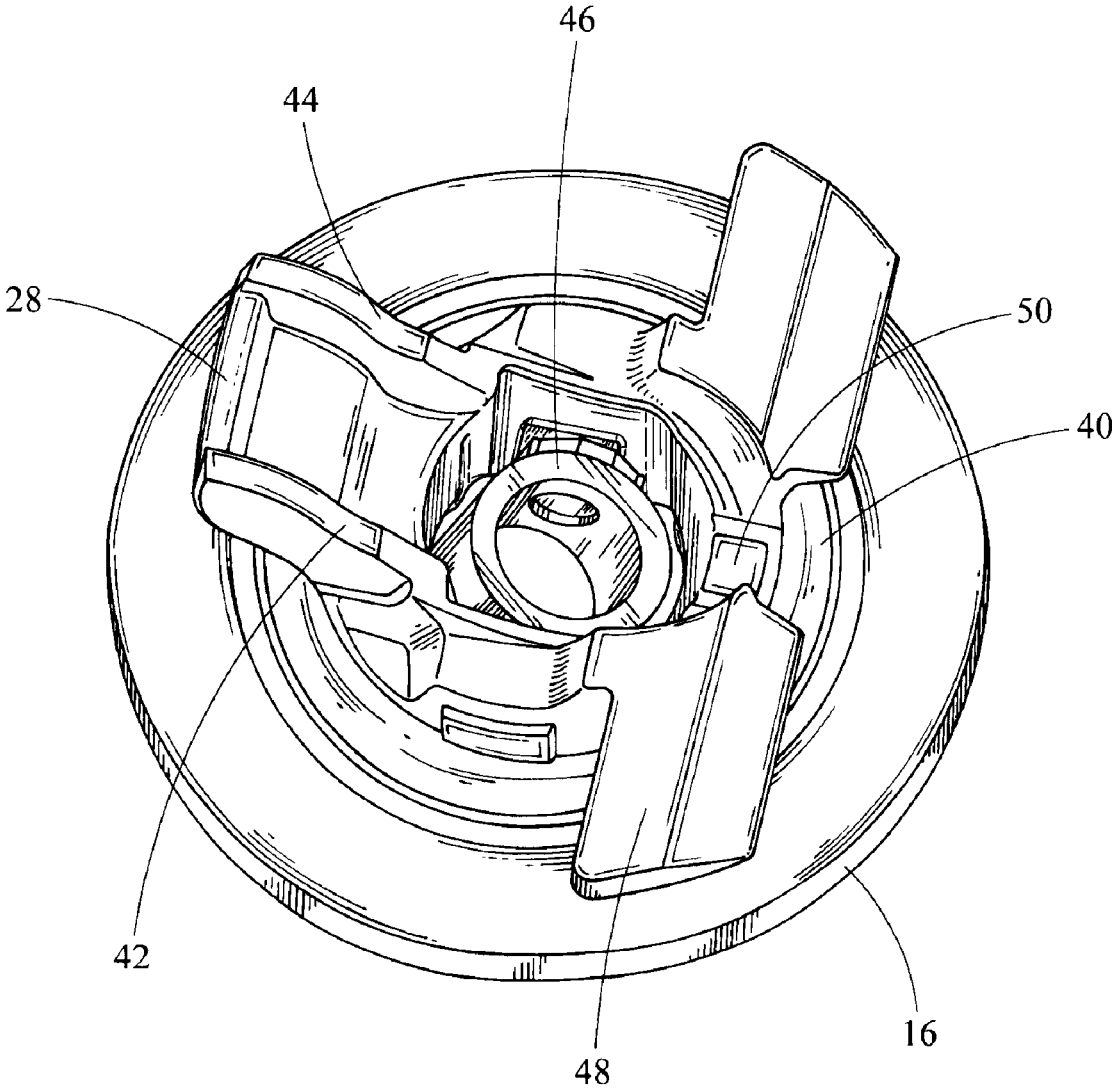
FIG. 3 is a perspective view of a swash plate illustrated in accordance with an embodiment of the present invention.

Referring now to FIG. 3, a more detailed view of swash plate 16 is illustrated in accordance with an embodiment of the present invention. Swash plate 16, as previously described includes the second hinge portion 28 that extends from a surface 40 of swash plate 16. Second hinge portion or hub 28 further includes cooperating surfaces 42 and 44. Cooperating surfaces 42 and 44 are configured to pivotably couple or mate with first hinge portion 26 of rotor 22 and a pin 64 (see FIG. 4) or pins 106, 108 (see FIG. 5). More specifically, in an embodiment of the present invention, surfaces 42 and 44 are bowl shaped support surfaces that are substantially curved allowing pivoting and sliding movement of the first hinge portion 26 thereon, as will be described in further detail below.

Swash plate 16 further includes a collar or sleeve 46 that is rotatably mounted within swash plate 16 by a pair of pivot pins. When swash plate 16 is assembled to rotor assembly 18, drive shaft 20 is inserted through collar 46. Collar 46 being rotatable within swash plate 16 allows swash plate 16 to rotate relative to drive shaft 20. Further, swash plate 16 includes a stop member 50. Stop member 50 cooperates with rotor 22 to stop the inclination of swash plate 16 at a predefined angle that corresponds with maximum refrigerant displacement.

Figure 4:
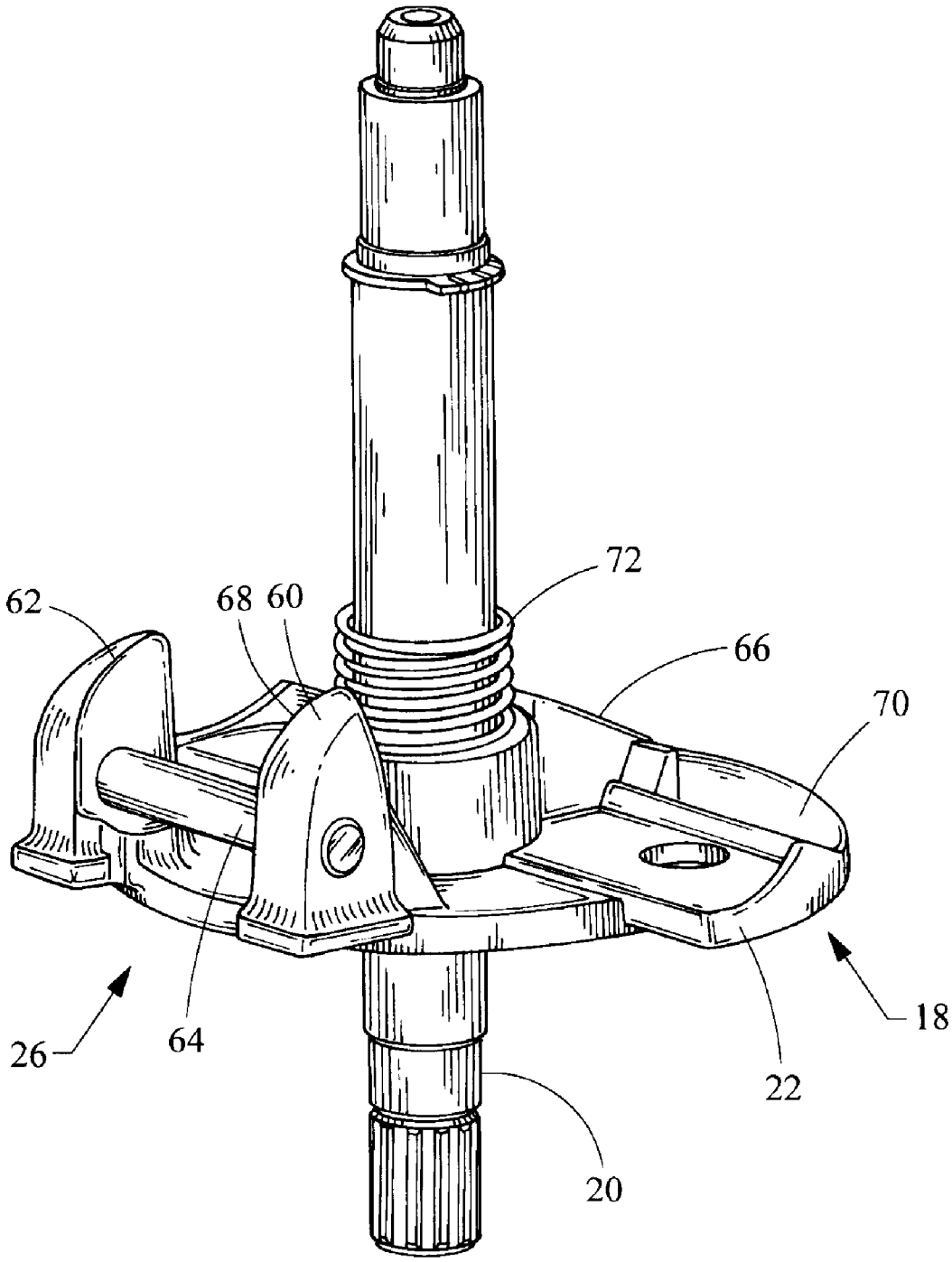
FIG. 4 is a perspective view of a rotor assembly illustrated in accordance with an embodiment of the present invention.

Referring now to FIG. 4, rotor assembly 18 is illustrated, in accordance with an embodiment of the present invention. Rotor assembly 18, as mentioned above, includes rotor 22 which has a pair of pin supports 60 and 62 that together with the pin 64 form the first hinge portion 26. Pin 64 has a diameter or profile that substantially corresponds with the profile of the curved surfaces 42 and 44 of the second hinge portion 28 of the swash plate 16. Pin 64 is press fitted into a bore in pin supports 60 and 62. Of course, the present invention contemplates the use of other methods for securing pin 64 to pin supports 60, 62, for example, by slip fitting the pin in bores in supports 60, 62 and securing the pin by staking, snap rings, welding or press fit caps. Thus, the aforementioned hinge configuration allows swash plate 16 to rotate about the pin 26 of the first hinge portion 26.

Rotor 22 further includes a stop seat 66 formed in a top surface 70 of rotor 22. Stop seat 66 cooperates with mating surface of stop member 50 of swash plate 16 to arrest the inclination of swash plate 16 about drive shaft 20 when the compressor is at maximum refrigerant pumping capacity. Rotor assembly 18 further includes a coil spring 72 that is mounted adjacent rotor 22 and biases swash plate 16 in a manner to reduce the angle of inclination of the swash plate relative to rotor 22 (i.e. away from rotor 22).

Figure 5:
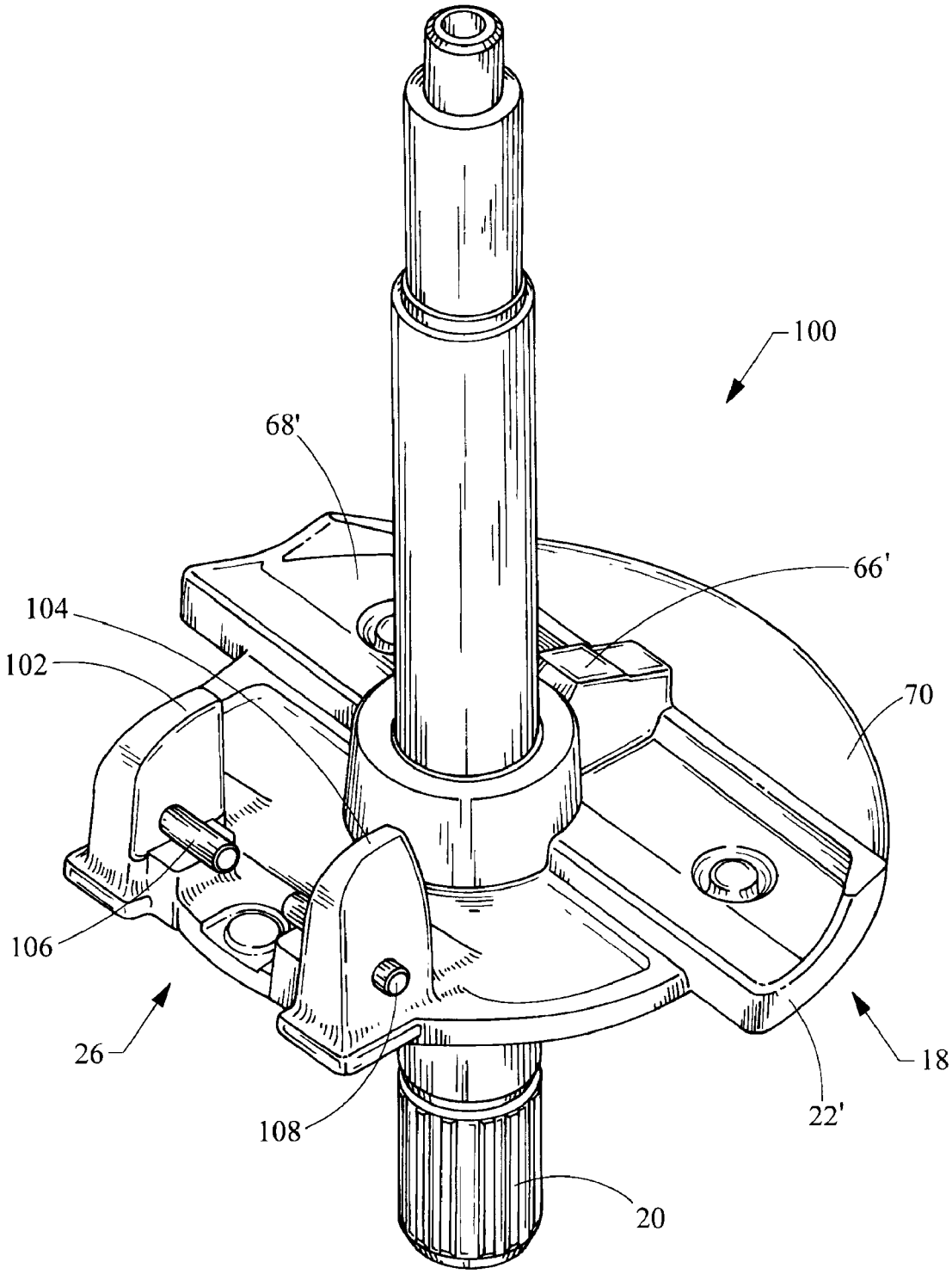
FIG. 5 is a perspective view of a rotor assembly illustrated in accordance with an embodiment of the present invention.
Figure 6:
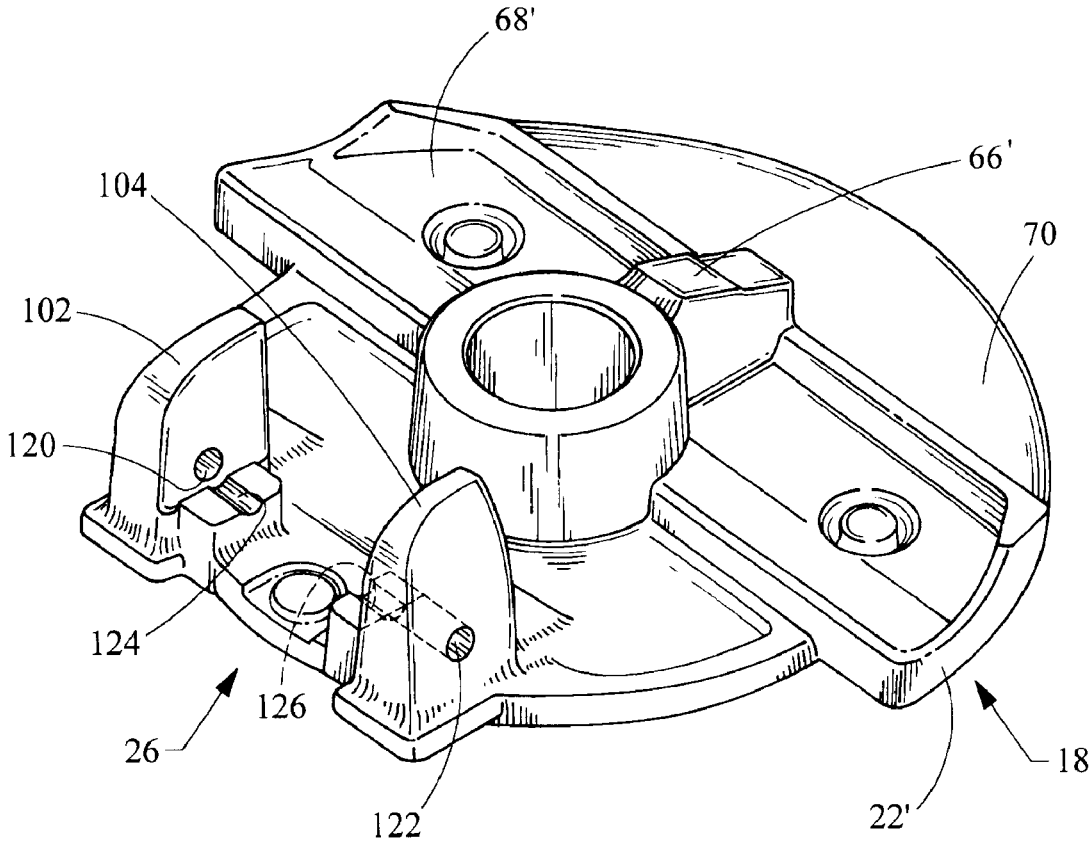
FIG. 6 is a perspective view of a rotor illustrated in accordance with an embodiment of the present invention.

Referring now to FIGS. 5 and 6, a rotor assembly 100 is illustrated, in accordance with another embodiment of the present invention. Rotor assembly 100 includes drive shaft 20, rotor 22', a pair of pin supports 102 and 104 and the hinge pins 106 and 108. Further, rotor 22' has a stop seat 66' formed in a top surface 70 of the rotor. The same or similar swash plate 16 may be assembled to rotor assembly 100 by sliding drive shaft 20 through collar or sleeve 46. Hub 28 of swash plate 16 is coupled to or mates with hinge pins 106 and 108 supported by pin supports 102 and 104 to form a hinge in a similar fashion to hinge 24 shown in FIG. 2. Hinge pins 106 and 108 may be secured to pin supports 102 and 104 in the manner as previously described for securing pin 64 to supports 60 and 62. Mating surfaces 42 and 44 of hub 28 of swash plate 16 rotates and slide on hinge pins 106 and 108, as described in previous embodiments. Surfaces 42 and 44 are arcuate or curved.

With continuing reference to FIG. 6, rotor 22' is shown in further detail illustrating the configuration of pin supports 102 and 104. As shown, pin supports 102 and 104 include through holes 120 and 122 and pin support surfaces 124 and 126. As shown in FIG. 5, hinge pins 106 and 108 are preferably pressed into through holes 120 and 122. Advantageously, support areas 124 and 126, which correspond with the profile of hinge pins 106 and 108, support hinge pins 106 and 108 along their length. Thus, the present embodiment achieves the benefits of hinge pins but with smaller diameters, which results in lower cost and lower mass of the rotor 22'. The lower mass reduces the noise and vibration produced by the rotation of the rotor assembly.

Figure 7:
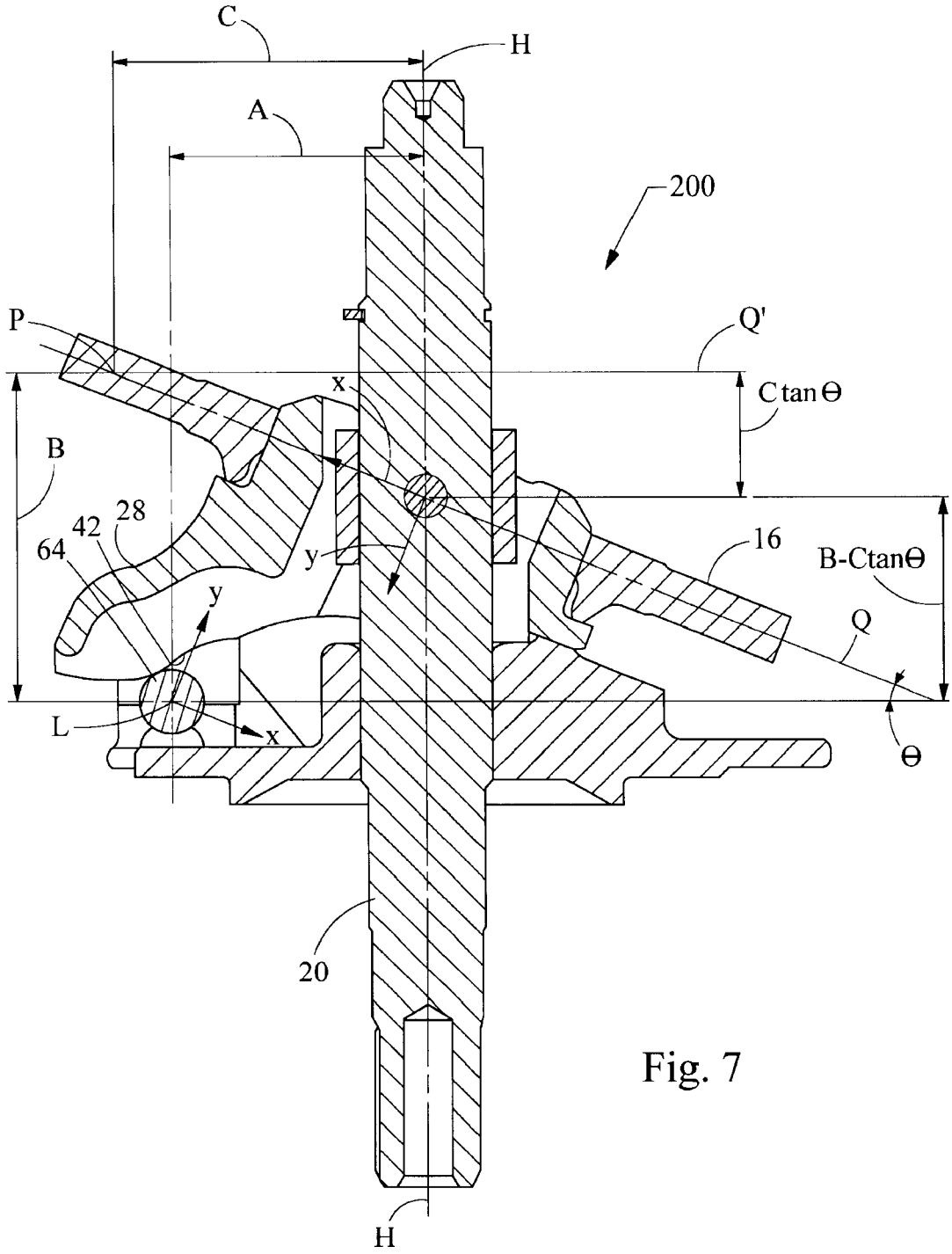
FIG. 7 is a section view of the swash plate coupled to the rotor assembly listing design parameter.
Figure 8:
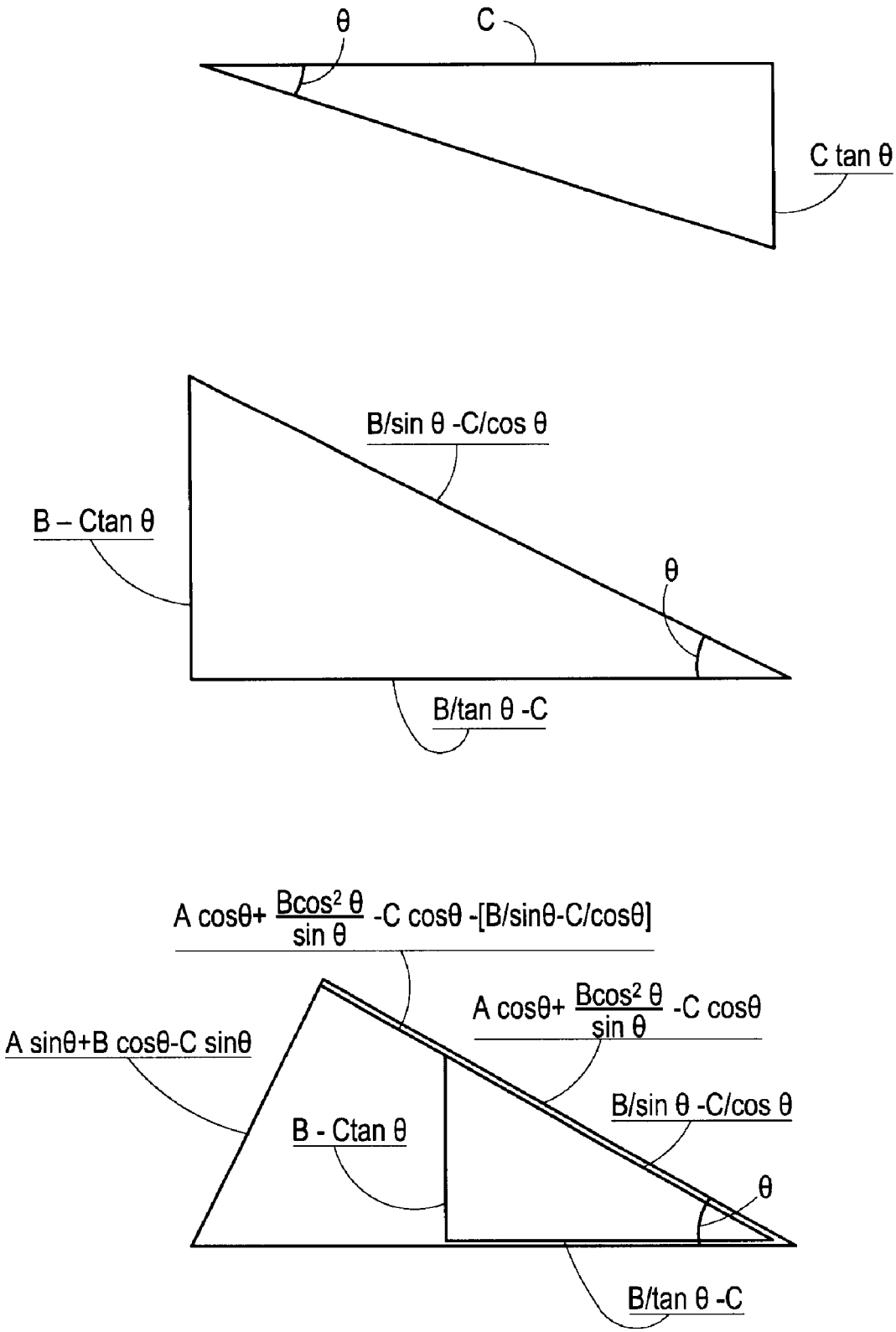

Referring now to FIG. 7, a method for determining the swash plate trajectory is illustrated and described in accordance with an embodiment of the present invention. A cam profile of mating surface 42 of hub 28 of the swash plate is determined with reference to trajectory schematic 200. The trajectory of swash plate 16 is calculated with respect to a coordinate axis system centered about the pivot axis L of the swash plate and by determining distances A, B and C as described below.

More specifically, the X axis of the coordinate system is parallel to the swash plate central plane Q and the Y axis of the coordinate system is normal to the swash plate central plane Q. Further, distance A is the horizontal distance from central axis H of drive shaft 20 to central axis L of pin 64. Further, distance B is the vertical distance between central plane Q running through swash plate 16 when the swash plate is at zero degrees of inclination relative to rotor 22 and central axis L of pin 64. Finally, distance C is the distance between the central axis H of drive shaft 20 and the projection of the central axis of one of the pistons 14 (not shown) coupled to swash plate 16, as represented by point P. From the above-described distances, equations are formulated to generate a curved trajectory that passes through the center of hinge pin 64 relative to the coordinate axis system described above. The cam equations are determined by the three triangles, seen in *Fig.* 8 which illustrate the mathematical relationships.

Combining the aforementioned mathematical relationships yields equation 1 and equation 2 shown below:

$$X = A\cos\theta + \frac{B\cos^2\theta}{\sin\theta} - C\cos\theta - \frac{B}{\sin\theta} + \frac{C}{\cos\theta} \tag{1}$$

$$Y = A\sin\theta + B\cos\theta - C\sin\theta \tag{2}$$

These equations describe a trajectory of swash plate 16 that passes through the center of hinge pin 64 to obtain the proper cam surface 42 on hub 28 that will ride on a diameter D of pin 64. An offset surface from Equation 1 that is offset by D/2 is machined. A compressor having the aforementioned characteristics will maintain a constant TDC regardless of the angle of swash plate 12 and does not have extra mass. Advantageously, the cam profile of the hub surfaces may be accomplished easily with conventional machining techniques to create the prescribed trajectory. The cup shaped support surfaces 42, 44 of hub 28 create a large moment of inertia, which makes it rigid, strong and low in mass, which also reduces the mass and vibration of the compressor.

The foregoing disclosure is the best mode devised by the inventor for practicing this invention. It is apparent, however, that methods incorporating modifications and variations will be obvious to one skilled in the art of hinges for a variable displacement compressor. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A variable displacement compressor, the compressor comprising:

a crankcase;

a cylinder block containing a plurality of chambers;

a plurality of pistons disposed within the cylinder block and configured for reciprocal movement within the plurality of chambers to pump a fluid;

a swash plate slidably coupled to the plurality of pistons and having a first hinge member extending from a surface of the swash plate, the first hinge member including a surface having a curved cam profile; and a rotor assembly having a rotor shaft and a rotor plate, wherein the rotor plate has a second hinge member extending from a surface of the rotor plate, whereby the surface of the first hinge member is configured to slide and rotate over the second hinge member forming a hinge about which the swash plate rotates the second hinge member defining a pivot axis for the swash plate.

2. The compressor of claim 1 wherein the surface of the first hinge member includes a pair of curved surfaces.

3. The compressor of claim 1 wherein a trajectory of the swash plate having the cam profile of the surface of the first hinge member is described by the following equations, wherein a coordinate axis system is centered about the pivot axis and an X axis of the coordinate system is parallel to a central plane of the swash plate and a Y axis of the coordinate system is normal to the central plane:

$$X = A\cos\theta + \frac{B\cos^2\theta}{\sin\theta} - C\cos\theta - \frac{B}{\sin\theta} + \frac{C}{\cos\theta} \text{ and}$$

$$Y = A\sin\theta + B\cos\theta - C\sin\theta$$

and

A is a lateral distance from a longitudinal axis of the rotor shaft to the pivot axis B is an axial distance from the pivot axis to the central plane of the swash plate when the swash plate is at zero degrees inclination C is a lateral distance from the longitudinal axis of the rotor shaft to a proiection axis of one of the pistons.

4. The compressor of claim 1 wherein the second hinge member includes a pin press fitted into a bore in the second hinge member.

5. The compressor of claim 1 wherein the second hinge member includes a pin slip fitted into a bore in the second hinge member.

6. The compressor of claim 4 further comprising a second hinge member surface for supporting the pin.

7. The compressor of claim 4 wherein the hinge is formed by the contact of the surface having the cam profile with the pin.

8. The compressor of claim 4 wherein the pin defines a pivot axis centrally therethrough and has a diameter D, the surface having the cam profile that is offset from the pivot axis of the pin by a distance D/2.

9. The compressor of claim 1 further comprising a spring disposed around the drive shaft for biasing the swash plate away from the rotor plate.

10. The compressor of claim 1 wherein the second hinge member includes a pair of pins.

11. The compressor of claim 10 further comprising a second hinge member surface for supporting the pair of pins.

12. The compressor of claim 10 wherein the pair of pins is press fitted into the second hinge member.

13. The compressor of claim 10 wherein the pair of pins is slip fitted into the second hinge member.

14. The compressor of claim 1 wherein the second hinge member includes a pin staked into the second hinge member.

15. The compressor of claim 1 wherein the second hinge member includes a pin welded into the second hinge member.

16. The compressor of claim 1 wherein the second hinge member includes a pin slip fitted into the second hinge member and retained by at least one clip.

17. The compressor of claim 1 wherein the second hinge member includes a pin slip fitted into the second hinge member.

* * * * *

UNITED STATES PATENT AND TRADEMARK OFFICE

CERTIFICATE OF CORRECTION

PATENT NO. : 7,455,009 B2
APPLICATION NO. : 11/450823
DATED : November 25, 2008
INVENTOR(S) : Michael G. Theodore, Jr. et al.

It is certified that error appears in the above-identified patent and that said Letters Patent is hereby corrected as shown below:

In the Claims

In column 6, claim 3, line 7, after "shaft to a" delete "proiection" and substitute --projection-- in its place.

Signed and Sealed this

Nineteenth Day of May, 2009

JOHN DOLL
*Acting Director of the United States Patent and Trademark Office*